US010393429B2

(12) United States Patent
Chen et al.

(10) Patent No.: US 10,393,429 B2
(45) Date of Patent: Aug. 27, 2019

(54) METHOD OF OPERATING NATURAL GAS LIQUEFACTION FACILITY

(71) Applicant: Air Products and Chemicals, Inc., Allentown, PA (US)

(72) Inventors: Fei Chen, Whitehouse Station, NJ (US); Brian Keith Johnston, Schnecksville, PA (US); Mark Julian Roberts, Kempton, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 573 days.

(21) Appl. No.: 15/091,883

(22) Filed: Apr. 6, 2016

(65) Prior Publication Data

US 2017/0292783 A1 Oct. 12, 2017

(51) Int. Cl.
*F25J 1/00* (2006.01)
*F25J 1/02* (2006.01)

(52) U.S. Cl.
CPC ..... *F25J 1/0022* (2013.01); *F25J 1/005* (2013.01); *F25J 1/0055* (2013.01); *F25J 1/0072* (2013.01); *F25J 1/0087* (2013.01); *F25J 1/0204* (2013.01); *F25J 1/0216* (2013.01); *F25J 1/0247* (2013.01); *F25J 1/0249* (2013.01); *F25J 1/0252* (2013.01); *F25J 1/0298* (2013.01); *F25J 2280/10* (2013.01)

(58) Field of Classification Search
CPC ..... F25J 1/0022; F25J 1/0249; F25J 1/055; F25J 1/0216; F25J 1/0245; F25J 1/0247; F25J 1/0252
See application file for complete search history.

(56) References Cited

U.S. PATENT DOCUMENTS

| | | | | |
|---|---|---|---|---|
| 4,809,154 | A | 2/1989 | Newton | |
| 5,791,160 | A | 8/1998 | Mandler et al. | |
| 6,272,882 | B1 * | 8/2001 | Hodges | F25J 1/0022 62/613 |
| 7,266,975 | B2 * | 9/2007 | Hupkes-Van Der Toorn | F25J 1/0022 62/612 |
| 2010/0326133 | A1 * | 12/2010 | Beeby | F25J 1/0214 62/614 |
| 2012/0079850 | A1 | 4/2012 | Sicinski et al. | |

(Continued)

FOREIGN PATENT DOCUMENTS

JP 2012-531575 12/2012

OTHER PUBLICATIONS

M. P. Calvache, et al, "Optimize LNG plant reliability: Controlling heat exchanger cool-down increases efficiency and availability", Hydrocarbon Process, Jul. 2008, 67-69.

(Continued)

*Primary Examiner* — Keith M Raymond
(74) *Attorney, Agent, or Firm* — Amy Carr-Trexler

(57) ABSTRACT

A method for controlling the flow of natural gas and refrigerant in the main heat exchanger of a natural gas liquefaction facility. The method provides for the automated control of a flow rate of a natural gas feed stream through a heat exchanger based on one or more process variables and set points. The flow rate of refrigerant streams through the heat exchanger is controlled by different process variables and set points, and is controlled independently of the flow rate of the natural gas feed stream.

27 Claims, 8 Drawing Sheets

(56) References Cited

U.S. PATENT DOCUMENTS

2018/0017320 A1* 1/2018 Bahari ..... F25J 1/0022

OTHER PUBLICATIONS

R. F. Stebbing, et al, "Core", The Oil and Gas Journal, Dec. 22, 1975, 46-49.
W. Sturm, et al, "Unlocking the Potential of Modern Control and Optimization Strategies in LNG Production", Proceedings of the 1st Annual Gas Processing Symposium, Jan. 10, 2009, 1-12.

* cited by examiner

| Controller Set point | Set Point in FIG. 2 or 4 | Example 1 (Warm initial start) | Example 2 (Cold restart) |
|---|---|---|---|
| MCHE 108 cool down rate | SP2 | 25 degrees C/hr | 25 degrees C/hr |
| MRV flow controller (296) | SP4 | 5 tonne/hr$^2$ | Hour 1 = 5 tonne/hr$^2$<br>Hours 2 & 3 = 10 tonne/hr$^2$<br>After 3hrs = 0 tonne/hr$^2$ (stop ramping) |
| MRL flow controller on MRL/MRV ratio (291) | SP10 | 2 | 1 |
| Suction pressure controller (302) | SP6 | 2.5 bara | 2.5 bara |
| Nitrogen MU controller (305) | SP9 | 2 tonne/hr if cold end temp < -120 degrees C | 2 tonne/hr if cold end temp < -120 degrees C |
| C2 MU controller (306) | SP7 | 3 tonne/hr if liquid level in separator 159 <40% | 3 tonne/hr if liquid level in separator 159 <40% |
| C3 MU controller (308) | SP8 | 2 tonne/hr if liquid level in separator 159 <40% | 2 tonne/hr if liquid level in separator 159 <40% |
| Cold Bundle Warm end DT controller (282) | SP3 | 10°C | 10°C |
| Warm Bundle Warm end DT controller (257) | SP5 | 12°C | 12°C |

FIG. 7

| Example/ Process Type | Average Cool down Rate, °C/hr | Cool down rate standard deviation | Fast temperature drop when MR condenses mitigated? | Total Flare of off-spec LNG, tonne | MCHE quenching avoided? |
|---|---|---|---|---|---|
| 1/Automatic | 20 | 9 | Yes | 73 | Yes |
| 1/Manual | 15 | 17 | No | 140 | Difficult |
| 2/Automatic | 19 | 10 | Yes | 46 | Yes |
| 2/Manual | 11 | 15 | No | 85 | Difficult |

FIG. 8

METHOD OF OPERATING NATURAL GAS LIQUEFACTION FACILITY

BACKGROUND

A number of liquefaction systems for cooling, liquefying, and optionally sub-cooling natural gas are well known in the art, such as the single mixed refrigerant (SMR) cycle, propane pre-cooled mixed refrigerant (C3MR) cycle, dual mixed refrigerant (DMR) cycle, C3MR-Nitrogen hybrid (such as the AP-X® process) cycles, nitrogen or methane expander cycle, and cascade cycles. Typically, in such systems, natural gas is cooled, liquefied, and optionally sub-cooled by indirect heat exchange with one or more refrigerants. A variety of refrigerants might be employed, such as mixed refrigerants, pure components, two-phase refrigerants, gas phase refrigerants, etc. Mixed refrigerants (MR), which are a mixture of nitrogen, methane, ethane/ethylene, propane, butanes, and optionally pentanes, have been used in many base-load liquefied natural gas (LNG) plants. The composition of the MR stream is typically optimized based on the feed gas composition and operating conditions.

The refrigerant is circulated in a refrigerant circuit that includes one or more heat exchangers and one or more refrigerant compression systems. The refrigerant circuit may be closed-loop or open-loop. Natural gas is cooled, liquefied, and/or sub-cooled by indirect heat exchange against the refrigerants in the heat exchangers.

Each refrigerant compression system includes a compression circuit for compressing and cooling the circulating refrigerant, and a driver assembly to provide the power needed to drive the compressors. The refrigerant is compressed to high pressure and cooled prior to expansion in order to produce a cold low pressure refrigerant stream that provides the heat duty necessary to cool, liquefy, and optionally sub-cool the natural gas.

Various heat exchangers may be employed for natural gas cooling and liquefaction service. Coil Wound Heat Exchangers (CWHEs) are often employed for natural gas liquefaction. CWHEs typically contain helically wound tube bundles housed within an aluminum or stainless steel pressurized shell. For LNG service, a typical CWHE includes multiple tube bundles, each having several tube circuits.

In a natural gas liquefaction process, natural gas is typically pre-treated to remove impurities such as water, mercury, acid gases, sulfur-containing compounds, heavy hydrocarbons, etc. The purified natural gas is optionally precooled prior to liquefaction to produce LNG.

Prior to normal operation of the plant, all the unit operations in the plant need to be commissioned. This includes start-up of natural gas pretreatment process if present, refrigerant compressors, pre-cooling and liquefaction heat exchangers, and other units. The first time a plant is started up is hereafter referred to as "initial start-up." The temperature that each portion of a heat exchanger operates at during normal operation is referred to as the "normal operating temperature." The normal operating temperature of a heat exchanger typically has a profile with the warm end having the highest temperature and the cold end having the lowest temperature. The normal operating temperature of a pre-cooling heat exchanger at its cold end and a liquefaction exchanger at its warm end is typically between −10 degrees C. and −60 degrees C. depending on the type of pre-cooling refrigerant employed. In the absence of pre-cooling, the normal operating temperature of a liquefaction heat exchanger at its warm end is near ambient temperature. The normal operating temperature of a liquefaction heat exchangers at its cold end is typically between −100 degrees C. and −165 degrees C., depending on the refrigerant employed. Therefore, initial start-up of these types of exchangers involves cooling the cold end from ambient temperature (or pre-cooling temperature) to normal operating temperature and establishing proper spatial temperature profiles for subsequent production ramp-up and normal operations.

An important consideration while starting up pre-cooling and liquefaction heat exchangers is that they must be cooled down in a gradual and controlled manner to prevent thermal stresses to the heat exchangers. It is desirable that the rate of change in temperature, as well as the temperature difference between hot and cold streams within the exchanger are within acceptable limits. This temperature difference could be measured between a specific hot stream and a cold stream. Not doing so may cause thermal stresses to the heat exchangers that can impact mechanical integrity, and overall life of the heat exchangers that may eventually lead to undesirable plant shutdown, lower plant availability, and increased cost. Therefore, care must be taken to ensure that heat exchanger cool-down is performed in a gradual and controlled manner.

The need to start-up the heat exchangers may also be present after the initial start-up of the plant, for instance during restart of the heat exchangers following a temporary plant shutdown or trip. In such a scenario, the heat exchanger may be warmed up from ambient temperature, hereafter referred to as "warm restart" or from an intermediate temperature between the normal operating temperature and ambient temperature, hereafter referred to as "cold restart." Both cold and warm restarts must also be performed in a gradual and controlled manner. The terms "cool-down" and "start-up" generally refer to heat exchanger cool-down during initial start-ups, cold restarts as well as warm restarts. FIG. 9 shows exemplary temperature profiles of a heat exchanger before and after a warm restart. FIG. 10 shows exemplary temperature profiles of a heat exchanger before and after a cold restart.

One approach is to manually control the heat exchanger cool-down process. The refrigerant flow rates and composition are manually adjusted in a step-by-step manner to cool down the heat exchangers. This process requires heightened operator attention and skill, which may be challenging to achieve in new facilities and facilities with high operator turnover rate. Any error on the part of the operator could lead to cool down-rate exceeding allowable limits and undesirable thermal stresses to the heat exchangers. Additionally, in the process, the rate of change of temperature is often manually calculated and may not be accurate. Further, manual start-up tends to be a step-by-step process and often involves corrective operations, and therefore is time consuming. During this period of start-up, feed natural gas from the exchanger is typically flared since it does not meet product requirements or cannot be admitted to the LNG tank. Therefore, a manual cool-down process would lead to large loss of valuable feed natural gas.

Another approach is to automate the cool-down process with a programmable controller. However, the approaches disclosed in the prior art are overly complicated and do not involve feed valve manipulations until the exchanger has already cooled down. This can easily lead to a large oversupply of refrigerant in the heat exchanger and would be inefficient. In the case of a two-phase refrigerant such as mixed refrigerant (MR), this could lead to liquid refrigerant at the suction of the MR compressor. Additionally, this method does not take advantage of the close interactions between the feed flow rate and refrigerant flow rate, which have a direct impact on hot and cold side temperatures. Finally, this method is rather an interactive (not automatic) process with the crucial decisions still having to be made by the operator. Its level of automation is limited.

Once the LNG plant has started up, various control schemes such as those described in U.S. Pat. Nos. 5,791,160 or 4,809,154 may be utilized to control parameters such as the LNG temperature, flow rate, heat exchanger temperature differences and so on. Such control schemes are different from those utilized during start-up and cannot be readily used for start-up purposes. Firstly, the temperature profiles are already established and are to be maintained relatively stable and feed gas and refrigerant flow rate do not need to be increased from zero as in the case of start-up. This eliminates one critical variable in the control scheme. Additionally, during normal operation, refrigerant composition may require no or small adjustments, unlike during start-up where larger adjustments need to be made throughout the start-up process. In the case of mixed refrigerant processes, refrigerant component inventory may not be available during start-up which further complicates the control process. Further, refrigerant compressors are often operating in recycle mode during start-up to prevent reaching the surge limit. These recycle valves may need to be gradually closed during the cool-down process, which is an additional variable to be adjusted. Furthermore, during start-up and heat exchanger cool down, the suction pressure needs to be monitored and refrigerant components (such as methane in the case of MR based process and N2 in N2 recycle process) need to be replenished in order to maintain a proper suction pressure. This also complicates the start-up operation.

One potential way to automate the cool down process would be to increase the natural gas feed flow rate while independently manipulating the refrigerant flow rate to control the cooldown rate as measured at the cold end of the heat exchanger. This method is found to be ineffective, because the cool down rate controller can have different and even reverse responses depending on the temperature and phase behavior of the refrigerant. The refrigerant not only serves as a cooling medium, but also a heat load in the heat exchanger before JT valve expansion. At the beginning of the process, increasing the refrigerant flowrate may cause the cooldown rate as measured at the cold end to actually slow before the refrigerant condenses in the tube circuit. Later in the cooldown process when the refrigerant entering the JT valve is condensed, increasing the flow increases the cool down rate. This reverse response makes the automation of such a control method very difficult or infeasible.

Overall, what is needed is a simple, efficient, and automated system and method for the start-up of heat exchangers in a natural gas liquefaction facility, while minimizing operator intervention.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

Described embodiments, as described below and as defined by the claims which follow, comprise improvements to compression systems used as part of a natural gas liquefaction process. The disclosed embodiments satisfy the need in the art by providing a programmable control system and method for adjusting the feed gas flow rate and the refrigerant flow rate in parallel and independently during the start-up of a natural gas liquefaction facility, thereby enabling the plant to start-up and cool down the MCHE (defined herein) efficiently, at desired cool down rate, and with minimal operator intervention.

In addition, several specific aspects of the systems and methods of the present invention are outlined below.

Aspect 1: A method for controlling the start-up of a liquefied natural gas (LNG) plant having a heat exchange system including a heat exchanger to achieve cool down of the heat exchanger by closed loop refrigeration by a refrigerant, the heat exchanger comprising at least one hot stream and at least one refrigerant stream, the at least one hot stream comprising a natural gas feed stream, and the at least one refrigerant stream being used to cool the natural gas feed stream through indirect heat exchange, the method comprising the steps of:

(a) cooling the heat exchanger from a first temperature profile at a first time to a second temperature profile at a second time, the first temperature profile having a first average temperature that is greater than a second average temperature of the second temperature profile; and (b) executing the following steps, in parallel during the performance of step (a):

(i) measuring a first temperature at a first location within the heat exchange system;

(ii) calculating a first value comprising a rate of change of the first temperature;

(iii) providing a first set point representing a preferred rate of change of the first temperature;

(iv) controlling a flow rate of the natural gas feed stream through the heat exchanger based on the first value and the first set point; and (v) independent of step (b)(iv), controlling the flow rate of a first stream of the at least one refrigerant stream such that the flow rate of the first refrigerant stream is greater at the second time than at the first time.

Aspect 2: The method of Aspect 1, wherein steps (b)(i) through (b)(iv) comprise:

(i) measuring (1) a first temperature at a first location within the heat exchange system and (2) a second temperature of the at least one hot stream at a second location and a third temperature of the at least one refrigerant stream at a third location within the heat exchange system;

(ii) calculating a first value comprising a rate of change of the first temperature and a second value comprising a difference between the second temperature and the third temperature;

(iii) providing a first set point representing a preferred rate of change of the first temperature and a second set point representing a preferred difference between the second temperature and the third temperature; and (iv) controlling a flow rate of the natural gas feed stream through the heat exchanger based on the first and second values calculated in step (b)(ii) and the first and second set points.

Aspect 3: The method of any of Aspects 1-2, wherein step (a) comprises:

(a) cooling the heat exchanger from a first temperature profile at a first time to a second temperature profile at a second time, the first temperature profile having a first average temperature that is greater than a second average temperature of the second temperature profile, the second temperature profile at its coldest location being less than −20 degrees C.

Aspect 4: The method of Aspect 3, wherein step (a) comprises:

(a) cooling the heat exchanger from a first temperature profile at a first time to a second temperature profile at a second time, the first temperature profile at its coldest location being greater than −45 degrees C., the second temperature profile at its coldest location being at least 20 degree C. colder than the temperature at the same location on the first temperature profile.

Aspect 5: The method of any of Aspects 2-4, wherein step (b)(i) further comprises:

(i) measuring (1) a first temperature at a first location within the heat exchange system and (2) a second temperature of the at least one hot stream at a second location and a third temperature of the at least one refrigerant stream at a third location, the third location being within a shell side of the heat exchanger.

Aspect 6: The method of any of Aspects 1-5, wherein step (b)(iii) further comprises:

(iii) providing a first set point representing a preferred rate of change of the first temperature, the first set point being a value or range that is between 5 and 30 degrees C. per hour.

Aspect 7: The method of any of Aspects 2-6, wherein step (b)(iii) further comprises:

(iii) providing a first set point representing a preferred rate of change of the first temperature and a second set point representing a preferred difference between the second temperature and the third temperature, the second set point comprising a value or range that is between zero and 30 degrees C.

Aspect 8: The method of any of Aspects 1-7, wherein step (b)(v) further comprises:

(v) independent of step (b)(iv), increasing a flow rate of a first refrigerant of the at least one refrigerant stream at a flow ramp rate.

Aspect 9: The method of Aspect 8, wherein step (b)(v) further comprises:

(v) independent of step (b)(iv), increasing the flow rate of a first refrigerant stream of the at least one refrigerant stream at a flow ramp rate, the flow ramp rate providing, at a third time that is between 2 and 8 hours after the first time, a flow rate for the first refrigerant stream that is 20-30% of the flow rate for the first refrigerant stream during normal operation of the plant.

Aspect 10: The method of any of Aspects 8-9, wherein step (b) further comprises:

(vi) measuring a flow rate of the second refrigerant stream and a flow rate of the first refrigerant stream;

(vii) calculating a second value comprising a ratio of the flow rate of the second refrigerant stream and the flow rate of the first refrigerant stream;

(viii) providing a second set point representing a preferred ratio of the flow rate of the second refrigerant stream and the flow rate of the first refrigerant stream; and (ix) independent of step (b)(iv), controlling the flow rate of the second refrigerant stream based on the second value and the second set point.

Aspect 11: The method of any of Aspects 1-10, wherein step (b) further comprises:

(vi) measuring a flow rate of the second refrigerant stream and a flow rate of the first refrigerant stream;

(vii) calculating a second value comprising a ratio of the flow rate of the second refrigerant stream and the flow rate of the first refrigerant stream;

(viii) providing a second set point representing a preferred ratio of the flow rate of the second refrigerant stream and the flow rate of the first refrigerant stream;

(ix) measuring a fourth temperature of the at least one hot stream at fourth location within the heat exchange system and a fifth temperature of the at least one refrigerant stream at a fifth location within the heat exchange system;

(x) calculating a third value comprising a difference between the fourth and fifth temperatures;

(xi) providing a third set point representing a preferred temperature difference between the fourth and fifth temperatures; and (xii) independent of step (b)(iv), controlling a flow rate of the second refrigerant stream based on (1) the second value and the second set point and (2) the third value and the third set point.

Aspect 12: The method of any of Aspects 2-11, wherein step (b) further comprises:

(v) measuring a fourth temperature of the at least one hot stream at fourth location within the heat exchange system and a fifth temperature of the at least one refrigerant stream at a fifth location within the heat exchange system; and (vi) independent of step (b)(iv), controlling a flow rate of the second refrigerant stream based on (1) a difference between the fourth temperature and the fifth temperature and (2) a ratio of the flow rate of the second refrigerant stream and the flow rate of the first refrigerant stream;

wherein the second and third locations are located within a first zone of the heat exchange system and the fourth and fifth locations are located within a second zone of the heat exchange system.

Aspect 13: The method of any of Aspects 1-12, wherein step (b)(i) further comprises:

(i) measuring (1) a first temperature at a first location within the heat exchange system and (2) a second temperature of the at least one hot stream at a second location and a third temperature of the at least one refrigerant stream at a third location within the heat exchange system, the second and third locations being at a warm end of the heat exchanger.

Aspect 14: The method of any of Aspects 1-13, wherein step (b)(iv) comprises:

(iv) controlling a flow rate of the natural gas feed stream through the heat exchanger using an automated control system to maintain the first value at the first set point.

Aspect 15: The method of any of Aspects 10-14, wherein step (b)(ix) comprises:

(ix) independent of step (b)(iv), controlling the flow rate of a second refrigerant stream using an automated control system to maintain the second value at the second set point.

Aspect 16: The method of any of Aspects 1-15, wherein the heat exchanger has a plurality of zones, each having a temperature profile, and step (b)(v) further comprises:

(v) independent of step (b)(iv), controlling the flow rate of a first stream of the at least one refrigerant stream such that the flow rate of the first refrigerant stream is greater at the second time than at the first time, the first stream providing refrigeration to a first zone of the plurality of zones, the first zone having a temperature profile with the lowest average temperature of all of the temperature profiles of the plurality of zones.

Aspect 17: The method of any of Aspects 1-16, wherein step (b)(ii) comprises:

(ii) calculating a first value consisting of a rate of change of the first temperature.

Aspect 18: The method of any of Aspects 2-17, wherein step (b)(vii) further comprises:

(vii) calculating a first value consisting of a rate of change of the first temperature and a second value comprising a difference between the second temperature and the third temperature.

Aspect 19: The method of any of Aspects 1-18, wherein step (b) further comprises:

(vi) controlling a make-up rate of at least one component of the refrigerant based on a measured refrigerant compressor suction pressure and a suction pressure set point.

Aspect 20: The method of any of Aspects 14-19, wherein step (b) further comprises:

(vi) controlling a make-up rate of at least one component of the refrigerant based on a measured suction pressure and a suction pressure set point, the suction pressure set point being within the range of 100-500 kPa.

Aspect 21: The method of any of Aspects 14-20, wherein step (b) further comprises:

(vi) controlling a make-up rate of a methane component of the refrigerant based on a measured refrigerant compressor suction pressure and a suction pressure set point.

Aspect 22: The method of any of Aspects 1-21, wherein step (b) further comprises:

(vi) controlling a make-up rate of a nitrogen component of the refrigerant based on at least one process condition, wherein the make-up rate of the nitrogen component is zero if any of the at least one process condition are not met.

Aspect 23: The method of Aspect 22, wherein step (b) further comprises:

(vii) controlling a make-up rate of a nitrogen component of the refrigerant based on at least one process condition, wherein the make-up rate of the nitrogen component is zero if any of the at least one process condition are not met, the at least one process condition including at least one selected from the group of: a temperature difference at a cold end of the heat exchange system between a hot stream and the at least one refrigerant stream being less than a temperature difference set point, a suction pressure at a suction drum being less than a suction pressure set point, a temperature taken at the cold end of the heat exchange system being less than a cold end temperature set point, and the first value being less than a temperature change set point.

Aspect 24: The method of any of Aspects 1-23, wherein step (b) further comprises:

(vi) controlling a make-up rate of at least one heavy component of the refrigerant based on a measured liquid level in a vapor-liquid separator and a liquid level set point.

Aspect 25: The method of any of Aspects 1-24, wherein step (b) further comprises:

(vi) controlling a make-up rate of at least one heavy component of the refrigerant based on a measured liquid level in a vapor-liquid separator and a liquid level set point, the liquid level set point being between 20 and 50%.

Aspect 26: The method of any of Aspects 1-25, wherein step (b) further comprises:

(vi) adding at least one heavy component of the refrigerant based at a first make-up rate when no liquid is detected in a vapor-liquid separator and adding the at least one heavy component based at a second make-up rate when liquid is detected in a vapor-liquid separator, the second make-up rate being greater than the first make-up rate.

Aspect 27: The method of any of Aspects 1-26, wherein the plant further comprises at least one compressor in fluid flow communication with the at least one refrigerant stream, wherein step (b) further comprises:

(vi) controlling at least one manipulated variable to maintain each of the at least one compressor at an operating condition that is at least a predetermined distance from surge, the at least one manipulated variable comprising at least one selected from the group of: compressor speed, recycle value position, and inlet vane position.

BRIEF DESCRIPTION OF DRAWINGS

FIG. 7 is a table showing set points associated with the automated cool down from the warm and cold restarts simulated in FIGS. 5-6;

FIG. 8 is a table comparing the results of five metrics for the automated cool down to manual cool down operations shown in FIGS. 5-6;

DETAILED DESCRIPTION OF INVENTION

Figure 1:
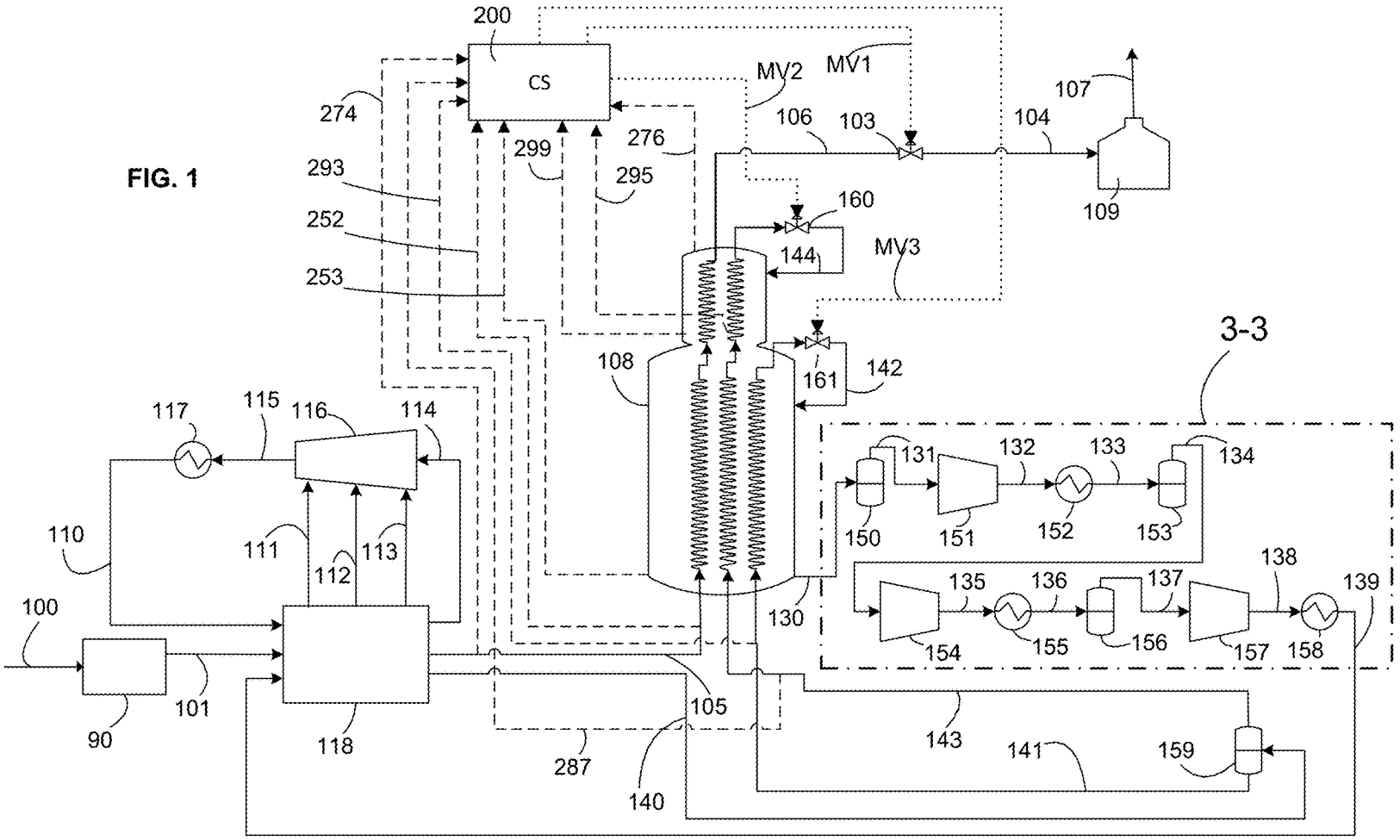
FIG. 1 is a schematic flow diagram of a C3MR system in accordance with a first exemplary embodiment of the invention.

The ensuing detailed description provides preferred exemplary embodiments only, and is not intended to limit the scope, applicability, or configuration of the claimed invention. Rather, the ensuing detailed description of the preferred exemplary embodiments will provide those skilled in the art with an enabling description for implementing the preferred exemplary embodiments of the claimed invention. Various changes may be made in the function and arrangement of elements without departing from the spirit and scope of the claimed invention.

Reference numerals that are introduced in the specification in association with a drawing figure may be repeated in one or more subsequent figures without additional description in the specification in order to provide context for other features.

In the claims, letters are used to identify claimed steps (e.g. (a), (b), and (c)). These letters are used to aid in referring to the method steps and are not intended to indicate the order in which claimed steps are performed, unless and only to the extent that such order is specifically recited in the claims.

Directional terms may be used in the specification and claims to describe portions of the present invention (e.g., upper, lower, left, right, etc.). These directional terms are merely intended to assist in describing exemplary embodiments, and are not intended to limit the scope of the claimed invention. As used herein, the term "upstream" is intended to mean in a direction that is opposite the direction of flow of a fluid in a conduit from a point of reference. Similarly, the term "downstream" is intended to mean in a direction that is the same as the direction of flow of a fluid in a conduit from a point of reference.

The term "temperature" of a heat exchanger may be used in the specification and claims to describe a thermal temperature of a specific location inside the heat exchanger.

The term "temperature profile" may be used in the specification, examples, and claims to describe a spatial profile of temperature along the axial direction that is in parallel with the flow direction of streams inside the heat exchanger. It may be used to describe a spatial temperature profile of a hot or cold stream, or of the metal materials of the heat exchanger.

Unless otherwise stated herein, any and all percentages identified in the specification, drawings and claims should be understood to be on a molar percentage basis. Unless otherwise stated herein, any and all pressures identified in the specification, drawings and claims should be understood to mean absolute pressure.

The term "fluid flow communication," as used in the specification and claims, refers to the nature of connectivity between two or more components that enables liquids, vapors, and/or two-phase mixtures to be transported between the components in a controlled fashion (i.e., without leakage) either directly or indirectly. Coupling two or more components such that they are in fluid flow communication with each other can involve any suitable method known in the art, such as with the use of welds, flanged conduits, gaskets, and bolts. Two or more components may also be coupled together via other components of the system that may separate them, for example, valves, gates, or other devices that may selectively restrict or direct fluid flow.

The term "conduit," as used in the specification and claims, refers to one or more structures through which fluids can be transported between two or more components of a system. For example, conduits can include pipes, ducts, passageways, and combinations thereof that transport liquids, vapors, and/or gases.

The term "natural gas", as used in the specification and claims, means a hydrocarbon gas mixture consisting primarily of methane.

The terms "hydrocarbon gas" or "hydrocarbon fluid", as used in the specification and claims, means a gas/fluid comprising at least one hydrocarbon and for which hydrocarbons comprise at least 80%, and more preferably at least 90% of the overall composition of the gas/fluid.

The term "mixed refrigerant" (abbreviated as "MR"), as used in the specification and claims, means a fluid comprising at least two hydrocarbons and for which hydrocarbons comprise at least 80% of the overall composition of the refrigerant.

The terms "heavy component", as used in the specification and claims, means a hydrocarbon that is a component of a MR and has a normal boiling point higher than methane.

The terms "bundle" and "tube bundle" are used interchangeably within this application and are intended to be synonymous.

The term "ambient fluid", as used in the specification and claims, means a fluid that is provided to the system at or near ambient pressure and temperature.

The term "compression circuit" is used herein to refer to the components and conduits in fluid communication with one another and arranged in series (hereinafter "series fluid flow communication"), beginning upstream from the first compressor or compression stage and ending downstream from the last compressor or compressor sage. The term "compression sequence" is intended to refer to the steps performed by the components and conduits that comprise the associated compression circuit.

As used in the specification and claims, the terms "high-high", "high", "medium", and "low" are intended to express relative values for a property of the elements with which these terms are used. For example, a high-high pressure stream is intended to indicate a stream having a higher pressure than the corresponding high pressure stream or medium pressure stream or low pressure stream described or claimed in this application. Similarly, a high pressure stream is intended to indicate a stream having a higher pressure than the corresponding medium pressure stream or low pressure stream described in the specification or claims, but lower than the corresponding high-high pressure stream described or claimed in this application. Similarly, a medium pressure stream is intended to indicate a stream having a higher pressure than the corresponding low pressure stream described in the specification or claims, but lower than the corresponding high pressure stream described or claimed in this application.

As used herein, the term "warm stream" or "hot stream" is intended to mean a fluid stream that is cooled by indirect heat exchange under normal operating conditions of the system being described. Similarly, the term "cold stream" is intended to mean a fluid stream that is warmed by indirect heat exchange under normal operating conditions of the system being described.

Table 1 defines a list of acronyms employed throughout the specification and drawings as an aid to understanding the described embodiments.

TABLE 1

| SMR | Single Mixed Refrigerant | MCHE | Main Cryogenic Heat Exchanger |
|---|---|---|---|
| DMR | Dual Mixed Refrigerant | MR | Mixed Refrigerant |
| C3MR | Propane-precooled Mixed Refrigerant | MRL | Mixed Refrigerant Liquid |
| LNG | Liquid Natural Gas | MRV | Mixed Refrigerant Vapor |

The described embodiments provide an efficient, automated process for starting up a hydrocarbon liquefaction process and are particularly applicable to the liquefaction of natural gas. Referring to FIG. 1, a first embodiment of the present invention is shown. This embodiment comprises a typical C3MR process, which is known in the art. A feed stream 100, which is preferably natural gas, is cleaned and dried by known methods in a pre-treatment section 90 to remove water, acid gases such as $CO_2$ and $H_2S$, and other contaminants such as mercury, resulting in a pre-treated feed stream 101. The pre-treated feed stream 101, which is essentially water free, is pre-cooled in a pre-cooling system 118 to produce a pre-cooled natural gas stream 105 and further cooled, liquefied, and/or sub-cooled in an MCHE 108 to produce LNG stream 106. Production control valve 103 can be used to adjust the flow rate of the LNG stream 106. The LNG stream 106 is typically let down in pressure by passing it through a valve or a turbine (not shown) and is then sent to LNG storage tank 109 by stream 104. Any flash vapor produced during the pressure letdown and/or boil-off in the tank is represented by stream 107, which may be used as fuel in the plant, recycled to feed, or vented.

The term "essentially water free" means that any residual water in the pre-treated feed stream 101 is present at a sufficiently low concentration to prevent operational issues associated with water freeze-out in the downstream cooling and liquefaction process.

Figure 1A:
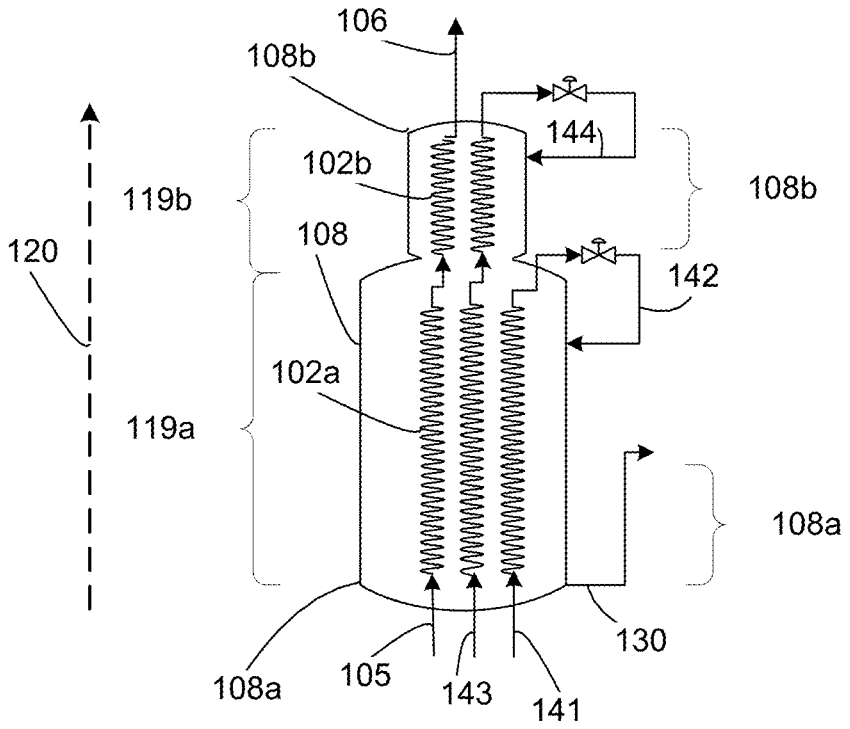
FIG. 1A is a partial schematic flow diagram, showing the MCHE portion of the C3MR system of FIG. 1.

The pre-treated feed stream 101 is pre-cooled to a temperature below 10 degrees Celsius, preferably below about 0 degrees Celsius, and more preferably about −30 degrees Celsius. The pre-cooled natural gas stream 105 is liquefied to a temperature between about −150 degrees Celsius and about −70 degrees Celsius, preferably between about −145 degrees Celsius and about −100 degrees Celsius, and subsequently sub-cooled to a temperature between about −170 degrees Celsius and about −120 degrees Celsius, preferably between about −170 degrees Celsius and about −140 degrees Celsius. MCHE 108 shown in FIG. 1A is a coil wound heat exchanger with two bundles. However, any number of bundles and any exchanger type may be utilized.

The pre-cooling refrigerant used in this C3MR process is propane. Propane refrigerant 110 is warmed against the pre-treated feed stream 101 to produce a warm low pressure propane stream 114. The warm low pressure propane stream 114 is compressed in one or more propane compressors 116 that may comprise four compression stages. Three side streams 111,112,113 at intermediate pressure levels enter the propane compressors 116 at the suction of the final, third, and second stages of the propane compressor 116 respectively. The compressed propane stream 115 is condensed in condenser 117 to produce a cold high pressure stream that is then let down in pressure (let down valve not shown) to produce the propane refrigerant 110 that provides the cooling duty required to cool pre-treated feed stream 101 in pre-cooling system 118. The propane liquid evaporates as it warms up to produce warm low pressure propane stream 114. The condenser 117 typically exchanges heat against an ambient fluid such as air or water. Although the figure shows four stages of propane compression, any number of compression stages may be employed. It should be understood that when multiple compression stages are described or claimed, such multiple compression stages could comprise a single multi-stage compressor, multiple compressors, or a combination thereof. The compressors could be in a single casing or multiple casings. The process of compressing the propane refrigerant is generally referred to herein as the propane compression sequence.

In the MCHE 108, at least a portion of, and preferably all of, the refrigeration is provided by vaporizing and heating at least a portion of refrigerant streams after pressure reduction across valves or turbines. A low pressure gaseous MR stream 130 is withdrawn from the bottom of the shell side of the MCHE 108, sent through a low pressure suction drum 150 to separate out any liquids and the vapor stream 131 is compressed in a low pressure (LP) compressor 151 to produce medium pressure MR stream 132. The low pressure gaseous MR stream 130 is typically withdrawn at a temperature near pre-cooling temperature or near ambient temperature if pre-cooling is absent.

The medium pressure MR stream 132 is cooled in a low pressure aftercooler 152 to produce a cooled medium pressure MR stream 133 from which any liquids are drained in medium pressure suction drum 153 to produce medium pressure vapor stream 134 that is further compressed in medium pressure (MP) compressor 154. The resulting high pressure MR stream 135 is cooled in a medium pressure aftercooler 155 to produce a cooled high pressure MR stream 136. The cooled high pressure MR stream 136 is sent to a high pressure suction drum 156 where any liquids are drained. The resulting high pressure vapor stream 137 is further compressed in a high pressure (HP) compressor 157 to produce high-high pressure MR stream 138 that is cooled in high pressure aftercooler 158 to produce a cooled high-high pressure MR stream 139. Cooled high-high pressure MR stream 139 is then cooled against evaporating propane in pre-cooling system 118 to produce a two-phase MR stream 140. Two-phase MR stream 140 is then sent to a vapor-liquid separator 159 from which an MRL stream 141 and a MRV stream 143 are obtained, which are sent back to MCHE 108 to be further cooled. Liquid streams leaving phase separators are referred to in the industry as MRL and vapor streams leaving phase separators are referred to in the industry as MRV, even after they are subsequently liquefied. The process of compressing and cooling the MR after it is withdrawn from the bottom of the MCHE 108, then returned to the tube side of the MCHE 108 as multiple streams, is generally referred to herein as the MR compression sequence.

Both the MRL stream 141 and MRV stream 143 are cooled, in two separate circuits of the MCHE 108. The MRL stream 141 is cooled and a least partially liquefied in the first bundle of the MCHE 108, resulting in a cold stream that is let down in pressure in MRL pressure letdown valve 161 to produce a two-phase MRL stream 142 that is sent back to the shell-side of MCHE 108 to provide refrigeration required in the first bundle of the MCHE. The MRV stream 143 is cooled in the first and second bundles of MCHE 108, reduced in pressure across the MRV pressure letdown valve 160, and introduced to the MCHE 108 as two-phase MRV stream 144 to provide refrigeration in the sub-cooling, liquefaction, and cooling steps. It should be noted that the MRV and MRL streams 144,142 may not always be two-phase during the cool down process.

MCHE 108 can be any exchanger suitable for natural gas liquefaction such as a coil wound heat exchanger, plate and fin heat exchanger or a shell and tube heat exchanger. Coil wound heat exchangers are the current state of art exchangers for natural gas liquefaction and include at least one tube bundle comprising a plurality of spiral wound tubes for flowing process and warm refrigerant streams and a shell space for flowing a cold refrigerant stream. Referring to FIGS. 1 and 1A, MCHE 108 is a coil wound heat exchanger in which the general direction of flow of the MRV and MRL streams 143,141 and the pre-cooled natural gas stream 105 is parallel to, and in the direction shown by, axis 120. The term "location", as used in the specification and claim in relation to the MCHE 108, means a location along the axial direction of flow of the streams flowing through the MCHE 108, represented in FIG. 1 A by axis 120.

As used in the specification and claims, the term "heat exchange system" means all of the components of the MCHE 108, including the outer surface of the shell of the MCHE 108, and any conduits that flow through the MCHE 108, plus any conduits that are in fluid flow communication with the MCHE 108 or the conduits that flow through the MCHE 108.

The heat exchange system has two zones, a warm zone 119*a* and a cold zone 119*b*, with a warm bundle 102*a* located in the warm zone 119*a* and a cold bundle 102*b* located in the cold zone 119*b*. In alternate embodiments, additional bundles could be included. In this context, the "zones" are regions of the MCHE 108 extending along the axis 120 and being separated by a location in which a fluid is removed or introduced into the MCHE 108. Each zone also includes any conduits that are in fluid flow communication with it. For example, the warm zone 119*a* ends and the cold zone 119*b* begins where stream 142 is removed from the MCHE 108, expanded, and reintroduced on the shell side of the MCHE 108.

In the context of the MCHE 108 or a portion thereof, the term "warm end" is preferably intended to refer to the end of the element in question that is at the highest temperature under normal operating conditions and, in the case of the MCHE 108, includes any conduits entering or exiting the MCHE 108 at the warm end. For example, the warm end 108*a* of the MCHE 108 located at its lowermost end in FIG. 1A and includes conduits 105, 143 and 141. Similarly, the term "cold end" is preferably intended to refer to the end of the element in question that is at the lowest temperature under normal operating conditions and, in the case of the MCHE 108, includes any conduits entering or exiting the MCHE 108 at the cold end. For example, the cold end 108*b* of the MCHE 108 is its uppermost end in FIG. 1A and includes conduits 106 and 144.

When an element is described as being "at" a cold end or warm, this is intended to mean that the element is located within the coldest (or warmest, depending upon which end is being described) 20% of the overall axial length of the element in question or within conduits entering or exiting that portion of the element in question. For example, if the axial height of the MCHE 108 (i.e., in the direction of axis 120) is 10 meters and a temperature reading is described as being taken "at the warm end" of the MCHE 108 and, then the temperature reading is being taken within 2 meters of the warm end 108*a* of the MCHE 108 or within any of the conduits 105, 143 and 141 entering or exiting that portion of the MCHE 108.

It should be understood that the present invention could be implemented in other types of natural gas liquefaction processes. For example, processes using a different pre-cooling refrigerant, such as a mixed refrigerant, carbon dioxide (CO2), hydroflurocarbon (HFC), ammonia (NH3), ethane (C2H6), and propylene (C3H6). In addition, the present invention could also be implemented in processes that do not use pre-cooling, for example, a single mixed refrigerant cycle (SMR). Alternate configurations could be used to provide refrigeration to the MCHE 108. It is preferable that such refrigeration be provided by a closed loop refrigeration process, such as the process used in this embodiment. As used in the specification and claims, a "closed loop refrigeration" process is intended to include refrigeration processes in which refrigerant, or components of the refrigerant may be added to the system ("made-up") during cool down.

Figure 2:
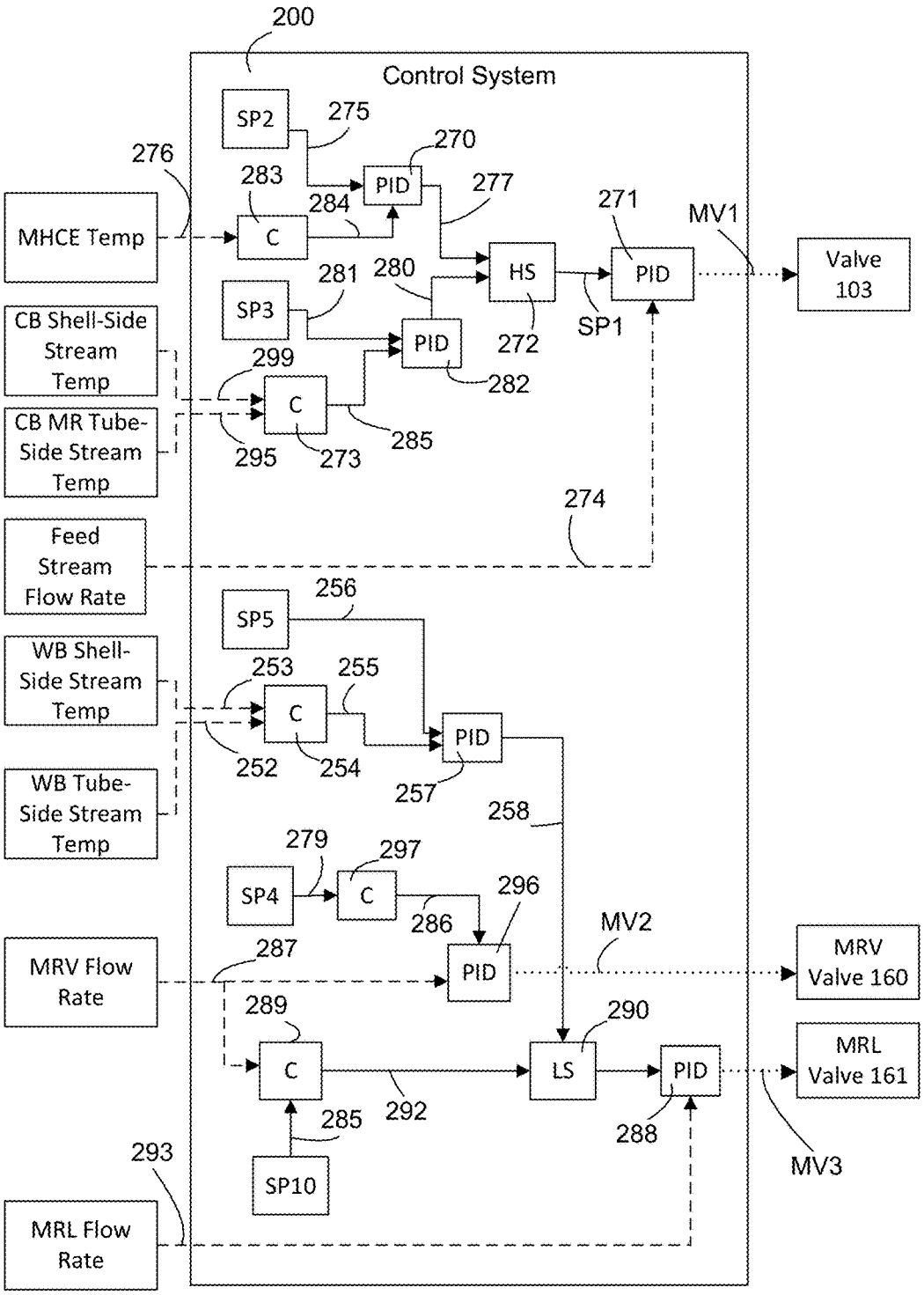
FIG. 2 is a schematic diagram showing a first portion the MCHE cool down control logic for the C3MR system of FIG. 1.

This embodiment includes a control system 200 that manipulates a plurality of process variables, each based on at least one measured process variable and at least one set point. Such manipulation is performed during startup of the process. Sensor inputs and control outputs of the control system 200 are schematically shown in FIG. 1 and the control logic is schematically shown in FIG. 2. It should be noted that the control system 200 could be any type of known control system capable of executing the process steps described herein. Examples of suitable control systems include programmable logic controllers (PLC), distributed control systems (DCS), and integrated controllers. It should also be noted that the control system 200 is schematically represented as being located in a single location. It is possible that components of the control system 200 could be positioned at different locations within the plant, particularly if a distributed control system is used. As used herein, the term "automated control system" is intended to mean any of the types of control systems described above in which a set of manipulated variables is automatically controlled by the control system based on a plurality of set points and process variables. Although the present invention contemplates a control system that is capable of providing fully automated control of each of the manipulated variables, it may be desirable to provide for the option for an operator to manually override one or more manipulated variables.

As used in the specification and claims, the term "set point" may refer to a single value or a range of values. For example, a set point that represents a preferred rate of change of temperature could be either a single rate (e.g., 2 degrees C. per minute) or a range (e.g., between 1 and 3 degrees C. per minute). Whether a set point is a single value or a range will often depend upon the type of control system being used. For purposes of this application, a control system using a set point consisting of a single value in combination with a gap value is considered equivalent to a set point comprising the range encompassed by the single value and the gap value. For example, a control system having a set point of 2 degrees C. per minute and a gap of 1 degree would make an adjustment to the manipulated variable only if the difference between the measured variable and the set point is greater than the gap value, which would be equivalent to a set point having a range of 1 to 3 degrees C. per minute.

The manipulated variables in this embodiment are the flow rates of the pre-cooled natural gas feed stream 105 (or any other location along the feed stream), the MRL stream 142 (or any other location along the MRL stream), and the MRV stream 144 (or any other location along the MRV stream). The monitored variables in this embodiment are the temperature difference between the hot and cold streams at one or more locations within the heat exchange system, as well as the rate of change of the temperature at one or more locations within a heat exchange system.

Although the temperature of the MCHE 108 could be measured at any location in the heat exchange system, the temperature of the MCHE 108 is typically measured at the outlet of the feed from the MCHE (LNG stream 106), or at the outlet of the MRV pressure letdown valve 160 (MRV stream 144), however it may be measured at the cold end of one or more bundles in MCHE 108, or at any other location within MCHE 108. It may also be measured at one or more tube-side streams inside the MCHE 108. The temperature can also be taken as the averaged value of what are measured at a combination of the above locations. The rate of change of the temperature of the MCHE 108 would then be calculated from temperature data over time.

The measured flow rate of the pre-cooled natural gas feed stream 105 is sent via signal 274 to a production flow controller 271 that compares the measured flow rate against a feed flow rate set point SP1. Alternatively, the flow rate of the feed stream may be measured at a different location, such as at the feed stream 100, at the LNG stream 106 before the LNG production valve 103, or at the LNG stream 104 after the LNG production valve 103.

In the specification and claims, when a temperature, pressure, or flowrate is specified as measuring a particular location of interest, it should be understood that the actual measurement could be taken at any location that is in direct fluid flow communication with the location of interest and where the temperature, or pressure, or flow rate is essentially the same as at the location of interest. For example, the refrigerant temperature 253 at the warm end of the heat exchanger in FIG. 1 may be measured inside the heat changer (as shown) or measured at the outlet stream from the shell side in stream 130, the suction drum 150, or stream 131, as these locations are essentially at the same temperature. Often, making such measurements at a different location is due to the different location being more convenient to access than the location of interest.

In this embodiment, there are two main factors that impact the feed flow rate set point SP1, the rate of change of MCHE 108 temperature and the temperature difference between cold and hot MR streams. Set point SP2 is the preferred rate of change of temperature at the cold end of MCHE 108. During initial start-up, the rate of temperature change set point SP2 is preferably a value between about 5 and 20 degrees Celsius per hour. During subsequent start-ups, such as warm and cold restarts, the rate of temperature change set point SP2 is preferably a value between about 20 and 30 degrees Celsius per hour. Both ranges are intended to prevent excessive thermal stresses on MCHE 108. The rate of temperature change set point SP2 is sent via a set point signal 275 to a controller 270, which compares a calculated rate of change of temperature sent via signal 284 to the rate of temperature change set point SP2. The rate of change of temperature is generated by a time derivative calculator 283, which reads MCHE 108 temperature from signal 276 and generates signal 284. Controller 270 generates a signal 277 to a production override controller 272 which is then integrated to convert the rate of change of feed flow rate to a feed flow rate value (SP1). Alternatively, the integration may be performed in controller 270, and signal 277 is sent to the production override controller 272.

In this embodiment, a temperature difference set point SP3, is the temperature difference between the MR shell-side stream and one of the tube-side streams (preferably the pre-cooled natural gas feed stream 105 or the MRV stream 143) in the cold bundle 102*b*. The temperature difference set point SP3 is preferably less than 30 degrees Celsius and, more preferably, less than 10 degrees Celsius. The temperature difference set point SP3 is sent via a set point signal 281 to a controller 282, which compares the temperature difference set point SP3 to the difference between the measured values provided by signals 295 and 299. The temperature difference is determined by subtraction calculator 273 that subtracts the measured temperature of the MR tube-side stream at a given point in time (provided via signal 295) from the measured temperature of the MR shell-side stream at that same point in time (provided via signal 299). The temperature sensors used to provide the temperature of the MR tube-side stream and the temperature of the MR shell-side stream are preferably located in the cold zone 119*b* and, more preferably, at the warm end of the cold bundle 102*b*. In other embodiments, they may be located at the warm end of the warm bundle 102*a* or any other location within the MCHE 108, preferably both temperatures are taken at roughly the same distance from the warm or cold end 108*a*,108*b* of the MCHE 108.

Controllers 270 and 282 each generate a signal 277, 280 to the production override controller 272, which determines the production (feed flow rate) set point SP1. In this embodiment, the production override controller 272 is a high-select logic calculator, which determines the greater value feed flow rate value indicated by the two signals 280 and 277. For example, if signal 277 is the higher value, the high select logic calculator will use the value of signal 277 to determine the value of the feed flow set point SP1. The configuration of the high-select logic calculator is not limited to the specific embodiment discussed here, as it can be done via other known methods of executing this logic calculation.

Production flow controller 271 then compares the feed flow set point SP1 to the measured feed stream flow rate, as indicated by signal 274, and sends a control signal MV1 to make any necessary adjustments to the position of the production control valve 103. For example, if the measured feed stream flow rate is below the value indicated by the feed flow set point SP1, control signal MV1 would further open the production control valve 103 to increase flow.

Independently of the feed flow rate adjustment logic described above, the flow rate of the refrigerant is increased during the start-up period based on a pre-determined ramp rate. In this embodiment, the flow rate of the MRV stream is increased at the predetermined ramp rate and is referred to as a MRV ramp rate set point SP4. A measured MRV flow rate is sent via signal 287 to MRV flow controller 296, which compares it to the MRV flow rate set point 286 that is calculated at 297 by integrating the ramp rate set point SP4 over time, and communicates what adjustment, if any, should be made to MRV flow control valve 160 via control signal MV2 to bring the actual MRV flow rate into line with the MRV flow rate set point SP4. The desired MRV flow rate at a given point in time is determined by integrating signal 279 using a time integrating calculator 297, which generates signal 286.

The MRV ramp rate set point SP4 is preferably set to achieve, between 6 and 8 hours from the beginning of the start-up process, an MRV flow rate that between 20% and 30% of the MRV flow rate during normal operation. In this embodiment, the MRV ramp rate set point SP4 is kept a constant value so that the MRV flow rate set point 286 to the MRV flow controller 296 linearly increases with time. However, the MRV ramp rate SP4 can be adjusted over the duration of the start-up process if deemed helpful. For example, the MRV ramp rate set point SP4 may be set at a higher value in a warm start-up or a warm restart than in a cold restart since the MRV in warm start-up scenarios is initially vapor phase.

In this embodiment, the MRL flow rate is set based on a high-select logic calculation based on the ratio the MRL/MRV flow rate and a temperature difference between the MR shell-side stream and one of the tube-side streams in the warm bundle 102*a*.

The MRV flow rate is sent via signal 287 to a calculator 289, which multiplies the MRV flow rate by the MRV/MRL ratio set point SP10 (sent via signal 285). The result of the calculation represents an MRL flow rate (either directly or in terms of the position of valve 161). It is preferable for the MRL/MRV flow rate ratio set point SP10 to be maintained at a fixed value so that the warm and cold bundles are cooled down at comparable rates. The MRL/MRV flow rate ratio during start-up should preferably be lower than that during normal operation. For this embodiment, which is a C3-MR liquefaction process, the ratio is preferably between 0 and 2 for an initial start-up or a warm restart and is preferably between 0 and 1 for cold restart.

The temperature difference set point SP5 is sent via a set point signal 256 to a controller 257, which compares the temperature difference set point SP5 to the difference between the measured values provided by signals 253 and 252 and generates a signal 258. The temperature difference is determined by subtraction calculator 254 that subtracts the measured temperature of the MR tube-side stream (provided via signal 252) from the measured temperature of the MR shell-side stream (provided via signal 253) and provides the difference to controller 257 via signal 255. The temperature sensors used to provide the temperature of the MR tube-side stream and the temperature of the MR shell-side stream are preferably located in the warm zone 119*a* and, more preferably, at the warm end of the warm bundle 102*a*. During start-up, the temperature difference set point is preferably no more than 15 degrees C. and, more preferably, no more than 10 degrees C.

The signal 292 from calculator 289 and signal 258 from controller 257 are sent to the MRL low selector 290. The MRL low selector 290 determines the controlling input based on a low-select logic calculation and use the lower value of the two as the set point to the MRL flow controller 288 via signal 294. For example, if the flow rate dictated by signal 258 is lower than that of signal 292, the MRL low selector 290 will select the value represented by signal 258 to transmit via signal 294. The MRL flow controller 288 compares the signal 294 to the current MRL flow rate (signal 293) and makes any necessary adjustment to the MRL flow control valve 161 via control signal MV3.

In alternate embodiments, the MRL flow rate could be ramped up pursuant to a constant ramp rate (i.e., an MRL flow rate set point) rather than controlled based on the MRV/MRL ratio. In such embodiments, the set point SP10 would be a flow ramp rate and the calculator 289 would be an integrator to convert the ramp rate set point to a MRL flow rate signal 292. The MRL flow rate set point to MRL flow controller 288 would be determined based on a high-select logic calculation based on the flow rate given by signal 292 and the flow rate called for by the hot and cold stream temperature difference controller 257. The MRV and MRL flow rates could be measured at any location, such as upstream of the MCHE 108 or upstream of the refrigerant control valves 160,161 (as shown in FIG. 1), or at a location within the MCHE 108.

A significant benefit of these arrangements is that it allows the feed natural gas flow rate to be varied independent of the flow rate of one of the refrigerant streams. The refrigerant flow rate is varied at a predetermined ramp rate, while the feed natural gas flow rate is adjusted to cool down the MCHE 108 at desired rate and prevent thermal stresses on the MCHE 108.

Figure 3:
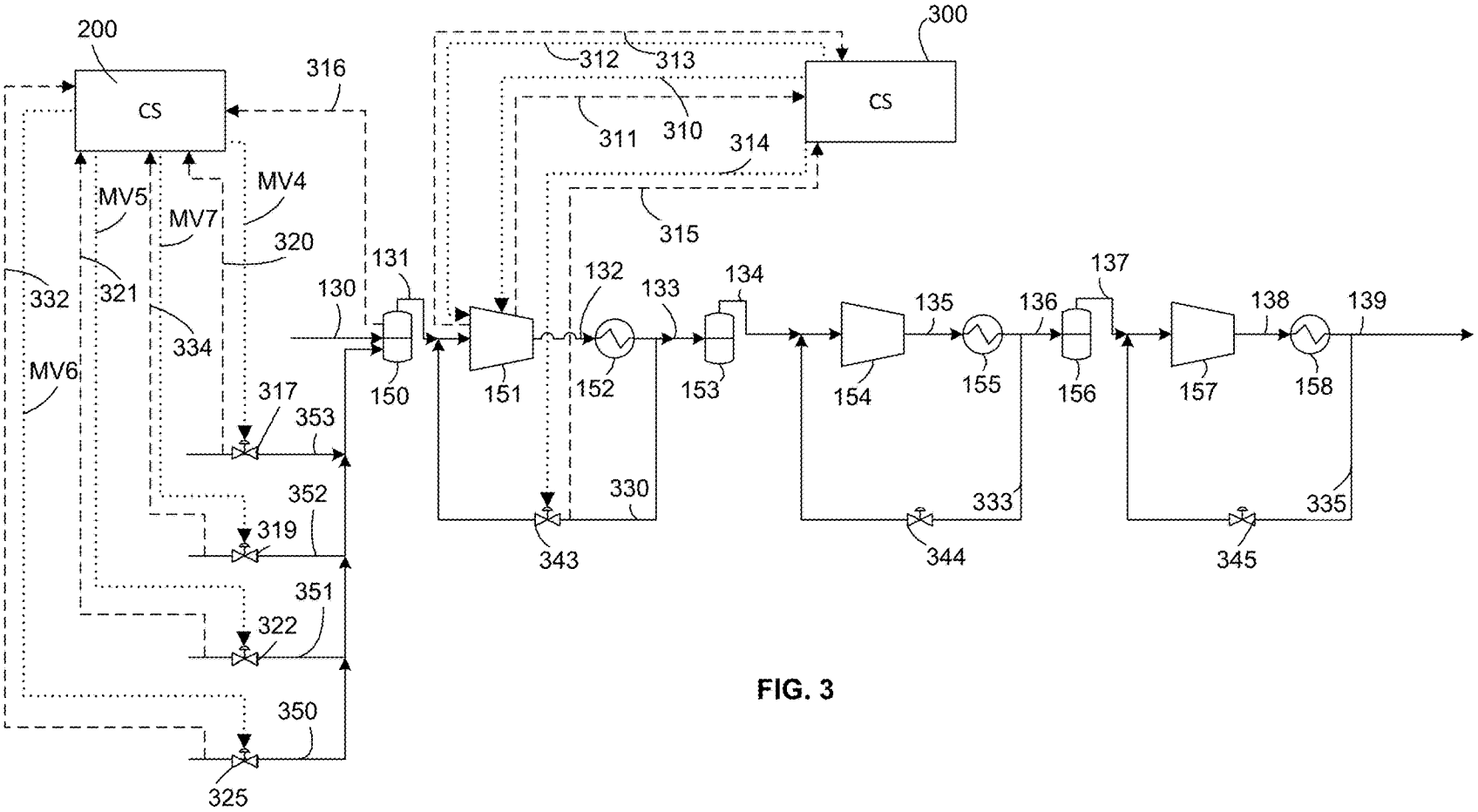
FIG. 3 is a more detailed schematic flow diagram of the portion of the C3MR system shown in area 3-3 of FIG. 1.

FIG. 3 shows another aspect of the invention as applied to a C3MR liquefaction facility. The manipulated variables shown in this figure can include MR compressor speed, inlet guide vane opening, MR anti-surge recycle valve opening, refrigerant composition, and make-up rates for each of the primary components of the MR. These variables may be manipulated together or individually.

MR compressor speed, inlet guide vane opening, MR anti-surge recycle valve opening are all preferably set and adjusted through a conventional compressor control system 300, which is commonly used in C3MR liquefaction facilities to control the operation of the compressor system during normal operation. One function of the compressor control system 300 is to keep compressors 151,154,157 away from the anti-surge limit. "Surge" is defined as a condition where the flow rate through each compressor 151,154,157 is lower than that required to allow stable compressor operation. The anti-surge limit is defined as the minimum acceptable distance from surge, for example 10%. In some embodiments, MR compressor speed and/or inlet guide vane opening may not be adjustable, leaving MR anti-surge recycle valve opening as the sole variable to be manipulated to keep the compressors 151,154,157 operating above the anti-surge limit.

In this embodiment, it is contemplated that the control logic of the compressor control system 300 will operate in the same manner as during normal operation, other than as specifically described herein. Accordingly, control logic diagrams are not provided for the compressor control system 300.

An exemplary group of control signals are shown in FIG. 3 in connection with compressor 151, recycle valve 343, recycle stream 330. Signal 315 indicates the flow rate of MR through the recycle stream 330, signal 311 indicates the pressure at the outlet of the compressor 151, and signal 313 indicates that pressure at the inlet of the compressor 151. Control signal 314 controls the position of the recycle valve 343, which is determined by the recycle valve set point. Control signal 310 controls the speed at which the compressor 151 is operated, which is determined by the compressor speed set point. Control signal 312 controls the position of the inlet vanes, which is determined by the inlet vane set point. It should be understood that that same group of control signals are provided for compressors 154,157, recycle valves 344,345, and recycle streams 333,335. In addition, different control configurations could be used.

Opening refrigerant recycle valves 343,344,345 each helps to keep a respective one of the compressors 151,154, 157 from surge through the recycling of a portion of the MR. Prior to MCHE 108 cool down, refrigerant recycle valves 343, 344, and 345 are typically at least partially open. Recycle valve openings are typically determined by the compressor control system 300 to keep the compressor from surge and are typically the same during MCHE cool down as during normal operation. However, the set point of the minimum acceptable distance from surge may be adjusted during MCHE 108 cool down to maintain a desired refrigeration capability by increasing compression ratio and boost discharge pressure. For example, if the MCHE 108 cool down rate is relatively low, then the recycle valves opening may be reduced to increase compression ratio and discharge pressure and therefore the cool down rate. The compression ratio is the ratio of the outlet to inlet pressure of each compressor 151,154,157.

If the compressors 151,154,157 are variable speed compressors, the compressor control system 300 may have a set point for the speed of compressors 151,154,157, either together or individually. The compressor speed set point may be kept constant throughout the entire MCHE 108 cool down process, or can be adjusted during the cool down process. For example, if desired MCHE 108 cool down rate is difficult to maintain, then the compressor speed set point could be increased to increase the compression ratio, and therefore, to help achieve the desired MCHE 108 cool down rate. The position of compressor inlet guide vanes (not shown), if present, may be adjusted in a similar way as the compressor speed.

For MR refrigerant systems, the MR composition may need to be adjusted during start-up. This is especially pertinent to initial start-up scenarios where inventory of all the refrigerant components have not been established in the system. Conversely, during warm or cold restarts where there is already inventory of all the refrigerant components, the MR composition may not need to be adjusted.

Figure 4:
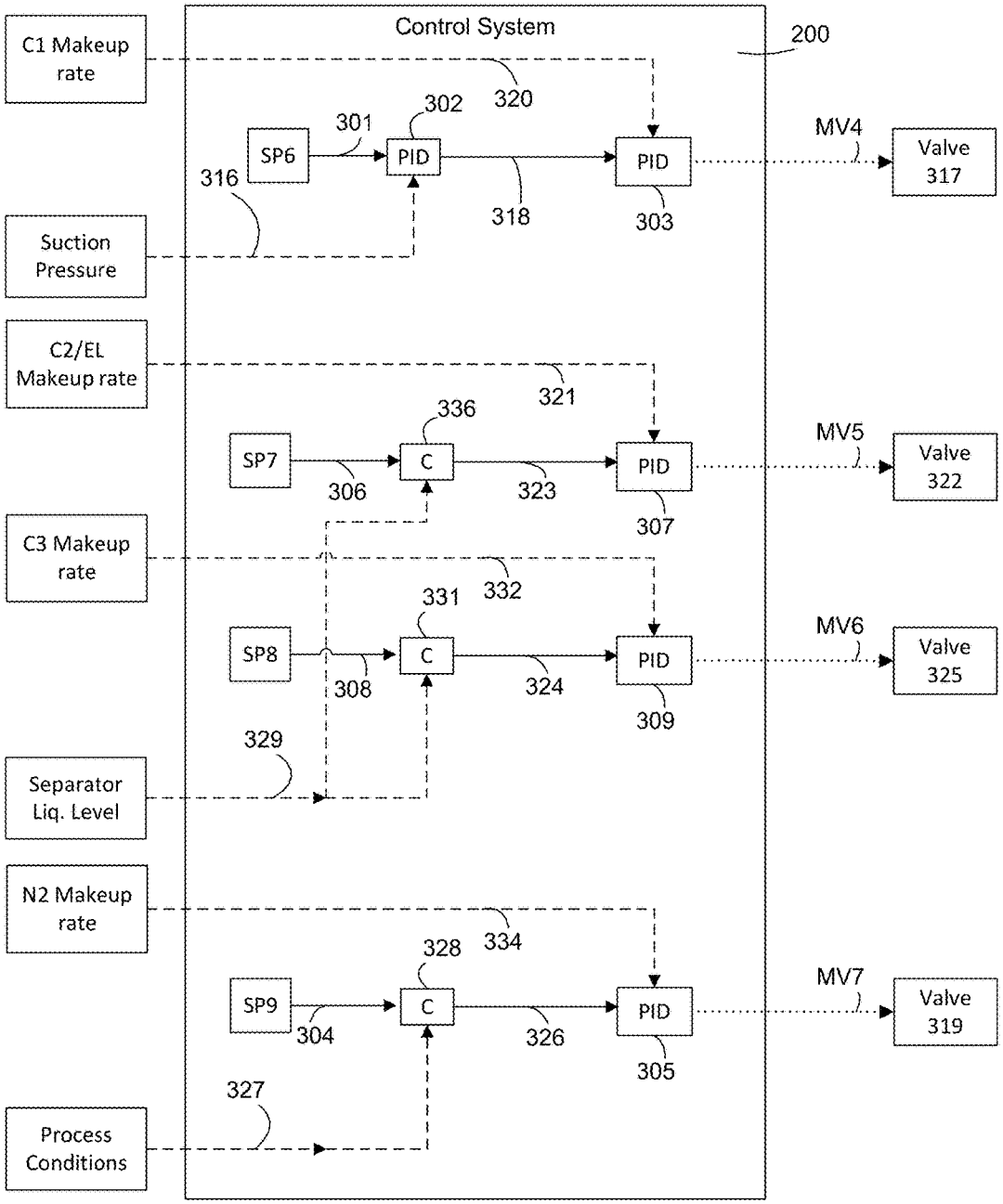
FIG. 4 is a schematic flow diagram showing a second portion the MCHE cool down control logic for the C3MR system of FIG. 1.

FIG. 3 shows a methane make-up stream 353, nitrogen make-up stream 352, ethane make-up stream 351, and propane make-up stream 350, with valves 317, 319, 322, and 325 that adjust the flow rate of each respective stream. Additional component make-up streams could also be present. FIG. 4 shows an exemplary control logic for the make-up streams.

The methane composition in the MR has an impact on the pressure of the low pressure gaseous MR stream 130. As the MCHE 108 is cooled down, the pressure of low pressure gaseous MR stream 130 as well as the pressure in the suction drum 150 decrease. In order to maintain the suction pressure, methane may be charged into the low pressure suction drum 150. The pressure of this suction drum 150 is measured and sent to a pressure controller 302 by signal 316. The pressure controller 302 compares the measured pressure to the MR pressure set point SP6, which is provided to the pressure controller 302 by a control signal 301. The MR pressure set point SP6 is preferably a value between 1 bara (15 psia) and 5 bara (73 psia) and, more preferably, a value between 2 bar (29 psia) and 3 bar (44 psia).

The pressure controller 302 sends a methane makeup rate set point signal 318 to a methane make-up flow controller 303. The measured flow rate of the methane makeup stream 353 is sent to the methane make-up flow controller 303 by signal 320. The methane make-up flow controller 303 then controls the opening of the methane make-up valve 317 via control signal MV4 to maintain methane makeup flow rate at the set point given by signal 318.

During the cool down process, nitrogen is typically not needed until the cold end 108*b* of the MCHE 108 reaches a relatively low temperature, such as −120 degrees Celsius. As the temperature differential across the MRV flow control valve 160 of FIG. 1 decreases, nitrogen make-up may be needed to complete the cool down process. A nitrogen flow rate set point and the measured flow rate of the nitrogen make-up stream 352 are sent to a nitrogen flow controller 305 via signals 334 and 326, respectively. The nitrogen flow controller 305 then adjusts the opening of the nitrogen make-up valve 319 via control signal MV7. The nitrogen make-up set point SP9 is typically set so that it is sufficient to increase the nitrogen content in the system from 0% to 10% in around 1 to 2 hours.

There are several process conditions that affect the make-up flow rate communicated by signal 326. In this embodiment, there are four process conditions that affect nitrogen make-up flow rate: (1) the temperature difference between the shell side and tube-side MR streams at the cold end 108*b* of the MCHE 108 (transmitted by signal 285) is preferably less than a predetermined number of degrees (e.g., 10 degrees C.); (2) the suction pressure (signal 316) at the suction drum 150 is preferably less than a predetermined pressure (e.g., 5 bara); (3) the cold end 108*b* temperature of the MCHE 108 (signal 276) is preferably less than a predetermined temperature (e.g., −120 degrees C.); and (4) the cool down rate of the MCHE 108 (signal 284) is preferably less than a predetermined rate of temperature change (e.g., 25 degrees per hour). The conditions are used individually or in combination to determine the process condition input signal 327.

These four process conditions are shown schematically as a single input in FIG. 4 and a single control signal 327. A calculator 328 generates the set point signal 326 based on the nitrogen make-up set point SP9 and data received via signal 327. The calculation performed will depend upon which process conditions are being monitored. In this embodiment, if any of the four process conditions identified above is not met, then the nitrogen make-up rate (set point signal 326) is zero. If all four of the process conditions are met, then the calculator 328 sets signal 326 to be equal to signal 304. In other embodiments, the process conditions could have different values and/or fewer process conditions could be used. For example, the nitrogen make-up rate could be set based only on maintaining the cold end 108*b* temperature of the MCHE 108 (signal 276) below a predetermined temperature.

Ethane and propane components are made up into the system by opening ethane make-up valve 322 and propane make-up valve 325 respectively. The composition of these components has a direct impact on the discharge pressure of the MR compressors, which in turn affects the MCHE 108 cool down rate that can be achieved. Ethane and propane components may be made-up independently or together. An ethane make-up set point SP7 is sent to ethane flow controller 307 via control signal 306. The ethane flow controller 307 adjusts the opening of ethane make-up valve 322. Similarly, the propane make-up set point SP8 is sent to propane flow controller 309 via signal 308, which adjusts the opening of propane make-up valve 325. Ethane and propane make-up set points SP7, SP8 are typically selected such that it is sufficient to accumulate significant liquid level in the MR separator 159 within 5-6 hours.

These components may be made-up at a predetermined rate until the liquid level in the vapor-liquid separator 159 reaches a desired value such as 30% (preferably between 20% and 60% and, more preferably, between 25% and 35%). A signal 329 transmits the liquid level from a sensor (not shown) in the vapor-liquid separator 159 to calculators 336 and 331 which determine ethane and propane flow rate set point signals 323,324 based on the ethane and propane make-up set points SP7,SP8 and data received via signal 329. For example, if the liquid level measurement 329 is less than 30%, calculators 336 and 331 would set their respective output signals 323 and 324 to be equal to signals 306 and 308, respectively. If the liquid level measurement 329 is above than 30%, calculators 336 and 331 would set their respective output signals 323 and 324 to be zero. Controllers 307,309 compare the ethane and propane set point signals 323,324 to signals 321,332 (representing ethane and propane flow rates, respectively) and generate control signals MV5 and MV6, which determine the position of valves 322,325, respectively.

Although FIGS. 1-4 and the associated description above refer to the C3MR liquefaction cycle, the invention is applicable to any other refrigerant type including, but not limited to, two-phase refrigerants, gas-phase refrigerants, mixed refrigerants, pure component refrigerants (such as nitrogen) etc. In addition, it is potentially useful in a refrigerant being used for any service utilized in an LNG plant, including pre-cooling, liquefaction or sub-cooling. The invention may be applied to a compression system in a natural gas liquefaction plant utilizing any process cycle including SMR, DMR, nitrogen expander cycle, methane expander cycle, AP-X, cascade and any other suitable liquefaction cycle.

In case of a gas phase nitrogen expander cycle, the refrigerant is pure nitrogen and therefore there is no need for a heavy MR component makeup controller. The nitrogen refrigerant flow rate may be ramped up according to a predetermined rate. The feed flow rate may be independently varied to prevent thermal stresses on the exchanger. The suction pressure of the nitrogen compressor may be maintained by adding nitrogen, similar to the way that methane is made up in the C3MR cycle.

EXAMPLES

The foregoing represent examples of the simulated application of cool down method in the present invention to a warm initial restart and a cold restart of the C3MR system shown in FIGS. 1-4. Warm initial restarts are usually performed when a plant is first started up after construction, or when the plant is restarted after an extended period of shutdown, during which the entire refrigerant system has been fully de-inventoried. The MCHE is at pre-cooling temperature (e.g., −35 to −45 degrees C.) in the case of C3-MR system and the MR circuit is full of methane with some residual heavy components possible. Cold restarts are usually performed after a plant operation has been stopped for a short period of time. A cold restart differs from warm initial restarts in the initial MCHE temperature profile and initial MR inventory. For a cold restart, although the warm end 108*a* temperature of the MCHE 108 is equal to the pre-cooling temperature, the cold end temperature can be any value between the pre-cooling temperature and the normal operating temperature (e.g., −160 degrees C.). Also, in a cold restart, there is an established MR inventory, including some liquid in the HP MR separator.

In the examples shown in FIG. 7, the modeled MCHE is designed to produce nominal 5 million tons per year (MTPA) of LNG. The predetermined set points for the automated cool down controllers are developed based on the project specific process and equipment design information. In both examples, compressor speeds were held constant and the distance from surge was 5%. Rigorous dynamic simulations were performed to evaluate the cool down process.

Figure 5:
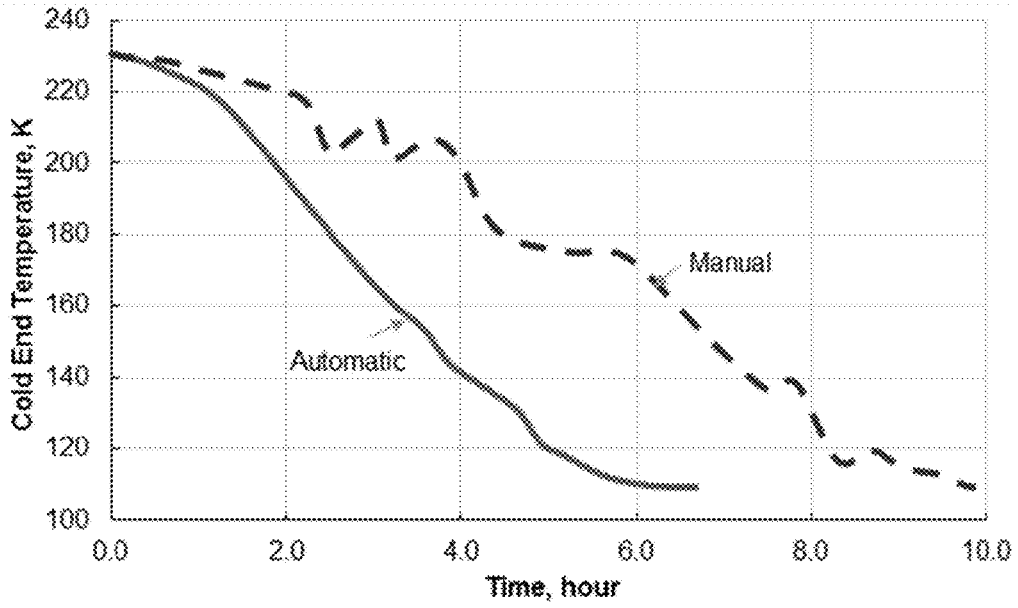
FIG. 5 is a graph showing the temperature of the cold end of an MCHE during simulated cool down from a warm restart, comparing cool downs with automated and manual control.
Figure 6:
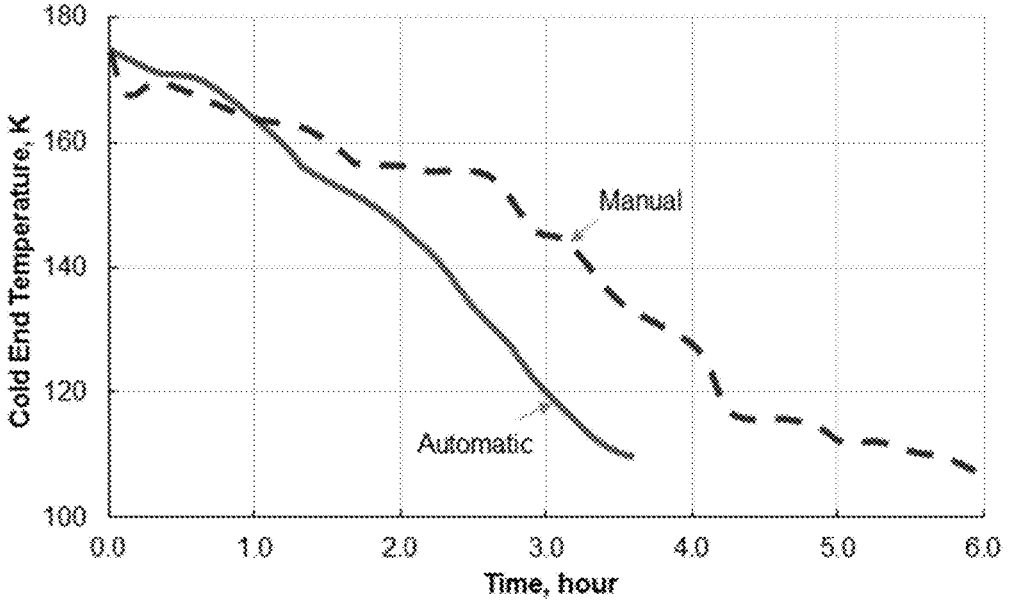
FIG. 6 is a graph showing the temperature of the cold end of an MCHE during simulated cool down from a cold restart, comparing cool downs with automated and manual control.
Figure 9:
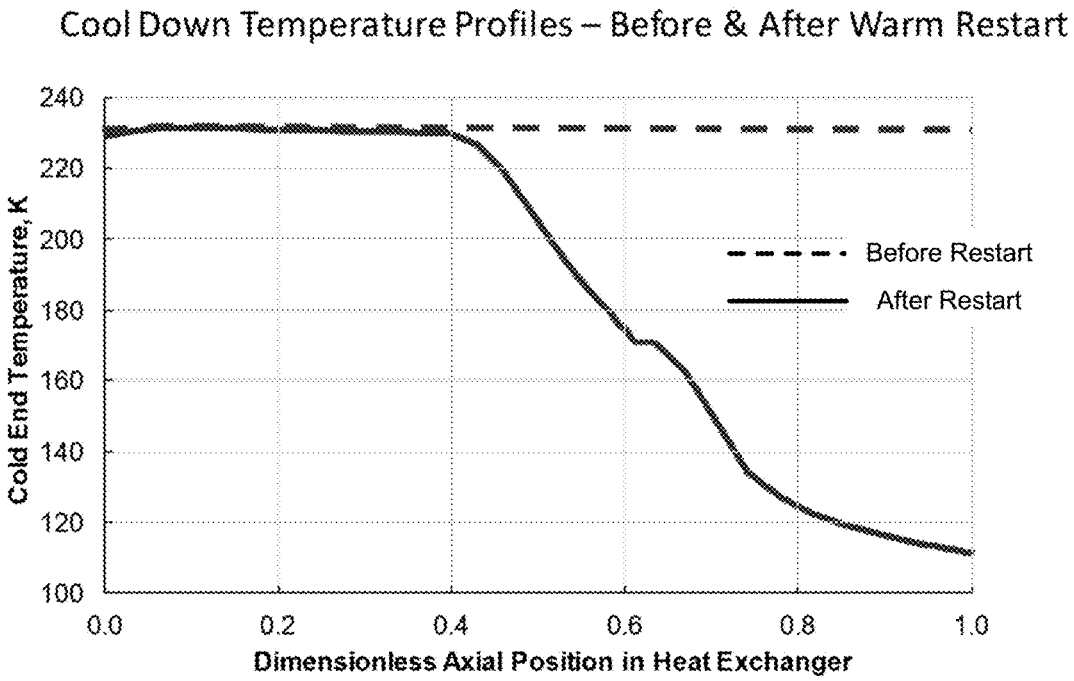
FIG. 9 is a graph showing temperature profiles of a heat exchanger before and after a warm restart.
Figure 10:
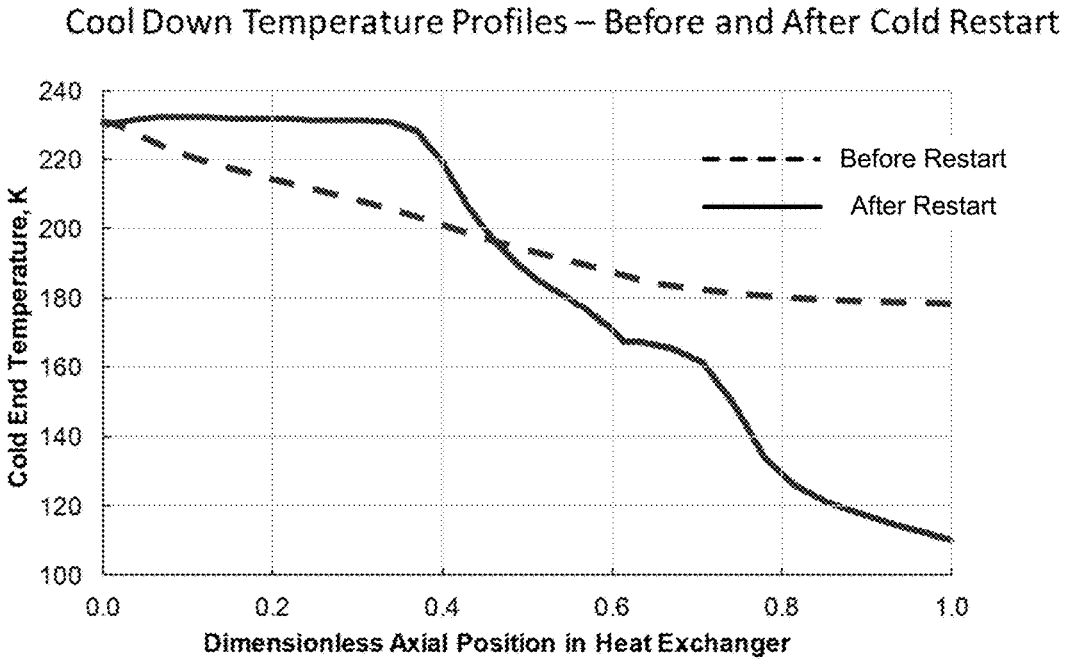
FIG. 10 is a graph showing temperature profiles of a heat exchanger before and after a cold restart.

FIGS. 5 and 6 show the MCHE cold end temperature as function of time obtained from the dynamic simulations and compare with expected manual cool down operations. A cool down process can be evaluated using 5 metrics:

1. To maintain an average cool down rate of about 25 degrees C./hr;
2. To maintain stable cool down rate (low standard deviation in cool down rate);
3. To mitigate fast temperature drop when MR condenses;
4. To minimize flare of off-spec LNG; and
5. To avoid MCHE "quenching" (extreme oversupply of refrigeration).

The automated cool down results are compared with manual operation using the above five metrics as shown in FIG. 8.

As can be seen from these results, the automated cool down method is effective to achieve a desired cool down rate with much less temperature excursions and reduced wasteful flaring. The method can also help mitigate sudden temperature drop when MR condenses and avoid MCHE quenching phenomena.

An invention has been disclosed in terms of preferred embodiments and alternate embodiments thereof. Of course, various changes, modifications, and alterations from the teachings of the present invention may be contemplated by those skilled in the art without departing from the intended spirit and scope thereof. It is intended that the present invention only be limited by the terms of the appended claims.

The invention claimed is:

1. A method for controlling the start-up of a liquefied natural gas plant having a heat exchange system including a heat exchanger to achieve cool down of the heat exchanger by closed loop refrigeration by a refrigerant, the heat exchanger comprising at least one hot stream and at least one refrigerant stream, the at least one hot stream comprising a natural gas feed stream, and the at least one refrigerant stream being used to cool the natural gas feed stream through indirect heat exchange, the method comprising the steps of:

(a) cooling the heat exchanger from a first temperature profile at a first time to a second temperature profile at a second time, the first temperature profile having a first average temperature that is greater than a second average temperature of the second temperature profile; and (b) executing the following steps, in parallel during the performance of step (a):

(i) measuring a first temperature at a first location within the heat exchange system;

(ii) calculating a first value comprising a rate of change of the first temperature;

(iii) providing a first set point representing a preferred rate of change of the first temperature;

(iv) controlling a flow rate of the natural gas feed stream through the heat exchanger based on the first value and the first set point; and (v) independent of step (b)(iv), controlling the flow rate of a first stream of the at least one refrigerant stream such that the flow rate of the first refrigerant stream is greater at the second time than at the first time.

2. The method of claim 1, wherein steps (b)(i) through (b)(iv) comprise:

(i) measuring the first temperature at the first location within the heat exchange system, a second temperature of the at least one hot stream at a second location, and a third temperature of the at least one refrigerant stream at a third location within the heat exchange system;

(ii) calculating the first value comprising the rate of change of the first temperature and a second value comprising a difference between the second temperature and the third temperature;

(iii) providing the first set point representing the preferred rate of change of the first temperature and a second set point representing a preferred difference between the second temperature and the third temperature; and (iv) controlling the flow rate of the natural gas feed stream through the heat exchanger based on the first and second values calculated in step (b)(ii) and the first and second set points.

3. The method of claim 1, wherein step (a) comprises:

(a) cooling the heat exchanger from the first temperature profile at the first time to the second temperature profile at the second time, the first temperature profile having the first average temperature that is greater than the second average temperature of the second temperature profile, the second temperature profile at its coldest location being less than −20 degrees C.

4. The method of claim 3, wherein step (a) comprises:

(a) cooling the heat exchanger from the first temperature profile at the first time to the second temperature profile at the second time, the first temperature profile at its coldest location being greater than −45 degrees C., the second temperature profile at its coldest location being at least 20 degree C. colder than the temperature at the same location on the first temperature profile.

5. The method of claim 2, wherein step (b)(i) further comprises:

(i) measuring the first temperature at the first location within the heat exchange system and the second temperature of the at least one hot stream at the second location and the third temperature of the at least one refrigerant stream at the third location, the third location being within a shell side of the heat exchanger.

6. The method of claim 1, wherein step (b)(iii) further comprises:

(iii) providing the first set point representing the preferred rate of change of the first temperature, the first set point being a value or range that is between 5 and 30 degrees C. per hour.

7. The method of claim 2, wherein step (b)(iii) further comprises:

(iii) providing the first set point representing the preferred rate of change of the first temperature and the second set point representing the preferred difference between the second temperature and the third temperature, the second set point comprising a value or range that is between zero and 30 degrees C.

8. The method of claim 1, wherein step (b)(v) further comprises:

(v) independent of step (b)(iv), increasing a flow rate of a first refrigerant of the at least one refrigerant stream at a flow ramp rate.

9. The method of claim 8, wherein step (b)(v) further comprises:

(v) independent of step (b)(iv), increasing the flow rate of the first refrigerant stream of the at least one refrigerant stream at the flow ramp rate, the flow ramp rate providing, at a third time that is between 2 and 8 hours after the first time, a flow rate for the first refrigerant stream that is 20-30% of the flow rate for the first refrigerant stream during normal operation of the plant.

10. The method of claim 8, wherein step (b) further comprises:

(vi) measuring a flow rate of a second refrigerant stream and a flow rate of the first refrigerant stream;

(vii) calculating a third value comprising a ratio of the flow rate of the second refrigerant stream and the flow rate of the first refrigerant stream;

(viii) providing a third set point representing a preferred ratio of the flow rate of the second refrigerant stream and the flow rate of the first refrigerant stream; and (ix) independent of step (b)(iv), controlling the flow rate of the second refrigerant stream based on the third value and the third set point.

11. The method of claim 1, wherein step (b) further comprises:

(vi) measuring a flow rate of a second refrigerant stream and a flow rate of the first refrigerant stream;

(vii) calculating a third value comprising a ratio of the flow rate of the second refrigerant stream and the flow rate of the first refrigerant stream;

(viii) providing a third set point representing a preferred ratio of the flow rate of the second refrigerant stream and the flow rate of the first refrigerant stream;

(ix) measuring a fourth temperature of the at least one hot stream at fourth location within the heat exchange system and a fifth temperature of the at least one refrigerant stream at a fifth location within the heat exchange system;

(x) calculating a fourth value comprising a difference between the fourth and fifth temperatures;

(xi) providing a fourth set point representing a preferred temperature difference between the fourth and fifth temperatures; and (xii) independent of step (b)(iv), controlling a flow rate of the second refrigerant stream based on the third value and the third set point and the fourth value and the fourth set point.

12. The method of claim 2, wherein step (b) further comprises:

(vi) measuring a fourth temperature of the at least one hot stream at fourth location within the heat exchange system and a fifth temperature of the at least one refrigerant stream at a fifth location within the heat exchange system; and (vii) independent of step (b)(iv), controlling a flow rate of a second refrigerant stream based on a difference between the fourth temperature and the fifth temperature and a ratio of the flow rate of the second refrigerant stream and the flow rate of the first refrigerant stream;

wherein the second and third locations are located within a first zone of the heat exchange system and the fourth and fifth locations are located within a second zone of the heat exchange system.

13. The method of claim 1, wherein step (b)(i) further comprises:

(i) measuring the first temperature at the first location within the heat exchange system, a second temperature of the at least one hot stream at a second location, and a third temperature of the at least one refrigerant stream at a third location within the heat exchange system, the second and third locations being at a warm end of the heat exchanger.

14. The method of claim 1, wherein step (b)(iv) comprises:

(iv) controlling the flow rate of the natural gas feed stream through the heat exchanger using an automated control system to maintain the first value at the first set point.

15. The method of claim 10, wherein step (b)(ix) comprises:

(ix) independent of step (b)(iv), controlling the flow rate of the second refrigerant stream using an automated control system to maintain the second value at the second set point.

16. The method of claim 1, wherein the heat exchanger has a plurality of zones, each having a temperature profile, and step (b)(v) further comprises:

(v) independent of step (b)(iv), controlling the flow rate of the first stream of the at least one refrigerant stream such that the flow rate of the first refrigerant stream is greater at the second time than at the first time, the first stream providing refrigeration to a first zone of the plurality of zones, the first zone having a temperature profile with the lowest average temperature of all of the temperature profiles of the plurality of zones.

17. The method of claim 1, wherein step (b)(ii) comprises:

(ii) calculating the first value consisting of the rate of change of the first temperature.

18. The method of claim 2, wherein step (b)(vii) further comprises:

(vii) calculating the first value consisting of the rate of change of the first temperature and the second value comprising the difference between the second temperature and the third temperature.

19. The method of claim 1, wherein step (b) further comprises:

(vi) controlling a make-up rate of at least one component of the refrigerant based on a measured refrigerant compressor suction pressure and a suction pressure set point.

20. The method of claim 1, wherein step (b) further comprises:

(vi) controlling a make-up rate of at least one component of the refrigerant based on a measured suction pressure and a suction pressure set point, the suction pressure set point being within the range of 100-500 kPa.

21. The method of claim 1, wherein step (b) further comprises:

(vi) controlling a make-up rate of a methane component of the refrigerant based on a measured refrigerant compressor suction pressure and a suction pressure set point.

22. The method of claim 1, wherein step (b) further comprises:

(vi) controlling a make-up rate of a nitrogen component of the refrigerant based on at least one process condition, wherein the make-up rate of the nitrogen component is zero if any of the at least one process condition are not met.

23. The method of claim 22, wherein step (b) further comprises:

(vii) controlling a make-up rate of the nitrogen component of the refrigerant based on at least one process condition, wherein the make-up rate of the nitrogen component is zero if any of the at least one process condition are not met, the at least one process condition including at least one selected from the group of a temperature difference at a cold end of the heat exchange system between a hot stream and the at least one refrigerant stream being less than a temperature difference set point, a suction pressure at a suction drum being less than a suction pressure set point, a temperature taken at the cold end of the heat exchange system being less than a cold end temperature set point, and the first value being less than a temperature change set point.

24. The method of claim 1, wherein step (b) further comprises:

(vi) controlling a make-up rate of at least one heavy component of the refrigerant based on a measured liquid level in a vapor-liquid separator and a liquid level set point.

25. The method of claim 1, wherein step (b) further comprises:

(vi) controlling a make-up rate of at least one heavy component of the refrigerant based on a measured liquid level in a vapor-liquid separator and a liquid level set point, the liquid level set point being between 20 and 50%.

26. The method of claim 1, wherein step (b) further comprises:

(vi) adding at least one heavy component of the refrigerant based at a first make-up rate when no liquid is detected in a vapor-liquid separator and adding the at least one heavy component based at a second make-up rate when liquid is detected in a vapor-liquid separator, the second make-up rate being greater than the first make-up rate.

27. The method of claim 1, wherein the plant further comprises at least one compressor in fluid flow communication with the at least one refrigerant stream, wherein step (b) further comprises:

(vi) controlling at least one manipulated variable to maintain each of the at least one compressor at an operating condition that is at least a predetermined distance from surge, the at least one manipulated variable comprising at least one selected from the group of: compressor speed, recycle value position, and inlet vane position.

* * * * *